US010378547B2

(12) United States Patent
Taroda et al.

(10) Patent No.: US 10,378,547 B2
(45) Date of Patent: Aug. 13, 2019

(54) AXIAL FLOW FAN

(71) Applicant: MINEBEA CO., LTD., Kitasaku-gun, Nagano (JP)

(72) Inventors: Atsushi Taroda, Kakegawa (JP); Yukihiro Higuchi, Fukuroi (JP); Tomoyoshi Sasajima, Fukuroi (JP)

(73) Assignee: MINEBEA CO., LTD., Kitasaku-gun (JP)

( * ) Notice: Subject to any disclaimer, the term of this patent is extended or adjusted under 35 U.S.C. 154(b) by 54 days.

(21) Appl. No.: 14/286,046

(22) Filed: May 23, 2014

(65) Prior Publication Data

US 2015/0030474 A1 Jan. 29, 2015

(30) Foreign Application Priority Data

Jul. 26, 2013 (JP) ..... 2013-155957

(51) Int. Cl.
*F04D 25/06* (2006.01)
*F04D 29/54* (2006.01)
*F04D 29/68* (2006.01)

(52) U.S. Cl.
CPC ..... *F04D 25/0613* (2013.01); *F04D 29/544* (2013.01); *F04D 29/681* (2013.01)

(58) Field of Classification Search
CPC .. F04D 25/0613; F04D 29/544; F04D 29/681; F04D 29/542; F04D 29/667; F04D 29/522; F04D 29/526; F04D 29/646; F04D 29/661; H05K 7/20136; H05K 7/20145; H05K 7/20172
See application file for complete search history.

(56) References Cited

U.S. PATENT DOCUMENTS 6,899,521 B2 * 5/2005 Horng ..... F04D 29/667 415/119
8,616,859 B2 * 12/2013 Kroeg ..... F04D 29/526 248/612
2007/0122271 A1 * 5/2007 Ishihara ..... F04D 25/0613 415/191
2008/0260530 A1 * 10/2008 Nishizawa ..... F04D 19/007 415/220
2011/0036312 A1 * 2/2011 Kroeg ..... F04D 29/526 123/41.65

FOREIGN PATENT DOCUMENTS

JP A-2008-261280 10/2008

* cited by examiner

*Primary Examiner* — Dominick L Plakkoottam
(74) *Attorney, Agent, or Firm* — Oliff PLC

(57) ABSTRACT

An axial flow fan includes an impeller having a hub and vanes disposed at equal intervals on an outer peripheral portion of the hub; a rotor shaft located at the center of the impeller; a motor portion rotating the impeller around the rotor shaft as an axis; a casing surrounding an outer periphery of the impeller; a base portion supporting the motor portion; and a stationary blade located in a blowout opening side of air flow, the stationary blade connecting the base portion and the casing, wherein the stationary blade has on its surface a guide portion allowing air flow flowing along the surface to be rectified and guided from a direction of the blowout opening to an outside.

8 Claims, 6 Drawing Sheets

AXIAL FLOW FAN

TECHNICAL FIELD

The present invention relates to an axial flow fan.

BACKGROUND ART

In the case of a general axial flow fan, air flow which flows out from the blowout opening tends to diffuse to the outer periphery direction, and the static pressure is not raised. Japanese Laid-open Patent Application Publication No. 2008-261280 reports an example which gives a devised stationary blade, in order to overcome this problem. From this, in the configuration of Japanese Laid-open Patent Application Publication No. 2008-261280, there is a possibility that a higher static pressure efficiency (=(static pressurexair flow quantity)/power consumption) is obtained, as compared to the static pressure efficiency of a conventional axial flow fan.

In Japanese Laid-open Patent Application Publication No. 2008-261280, a stationary blade is disclosed which is divided to two parts of an inner side and an outer side by an annular ring. The blade width of the outer side stationary blade is made larger than the blade width of the inner side stationary blade. Therefore, in the region away from the central axis, a component turning in the circumferential direction of the air flow through the outer stationary blade is converted to the central axis direction efficiently, and in the region close to the center axis, the influence of the resistance which the air flow receives can be reduced. As a result, the static pressure-air flow quantity characteristics can be improved, they say.

However, with regard to the configuration of the stationary blade disclosed in Japanese Laid-open Patent Application Publication No. 2008-261280, many items to be designed exist, such as how to set the far extent of the inner side stationary blade from the central axis and from where the outer side stationary blade is to be defined, and how to design the shape of each of the two stationary blades of the inner side stationary blade and the outer side stationary blade, and so the cost for designing increases. Further, because the structure of the stationary blade including the annular ring structure is complicated, the metal mold grows expensive. Thus, with the complicated structure of the stationary blade, the manufacturing cost increases and as a result, a rise in the product price is caused.

CITATION LIST

Patent Literature

Patent Literature 1: Japanese Laid-open Patent Application Publications No. 2008-261280

SUMMARY OF INVENTION

Technical Problem

The present invention has been carried out in view of such circumstances. It is an object of the present invention to provide an axial flow fan capable of achieving higher static pressure efficiency while suppressing an increase in the product price.

Solution to Problem

In order to achieve the above object, the present invention can be understood by the following configurations.

(1) In accordance with a first aspect of the present invention, an axial flow fan comprises: an impeller having a hub and vanes disposed at equal intervals on an outer peripheral portion of the hub; a rotor shaft located at the center of the impeller; a motor portion rotating the impeller around the rotor shaft as an axis; a casing surrounding an outer periphery of the impeller; a base portion supporting the motor portion; and a stationary blade located in a blowout opening side of air flow, the stationary blade connecting the base portion and the casing, wherein the stationary blade has on its surface a guide portion allowing air flow flowing along the surface to be rectified and guided from a direction of the blowout opening to an outside.

(2) In the above configuration (1), the guide portion may be provided on a surface directed to the blowout opening side of the stationary blade.

(3) In the above configuration (1) or (2), the guide portion may be integrally provided from a base portion side to a casing side of the stationary blade.

(4) In any one of the above configurations (1) to (3), the guide portion may be, in a cross sectional view, an L-shaped groove having a longitudinal wall parallel to the rotor shaft.

(5) In any one of the above configurations (1) to (3), the guide portion may be, in a cross sectional view, an inverse L-shaped projection having a longitudinal wall parallel to the rotor shaft.

(6) In any one of the above configurations (1) to (5), the guide portion may be, in a direction along the axis, provided between a center position of the stationary blade and an end portion of the blowout opening side thereof.

Advantageous Effects of Invention

According to the present invention, it is possible to provide an axial flow fan capable of achieving higher static pressure efficiency while suppressing an increase in the product price.

DESCRIPTION OF EMBODIMENTS

Hereinafter, embodiments for carrying out the present invention (hereinafter, referred to as "embodiment") shall be described with reference to the accompanying drawings.

Throughout the description of the embodiment, the same number is given to the same element.

(Overall Structure of Axial Flow Fan)

Figure 1:
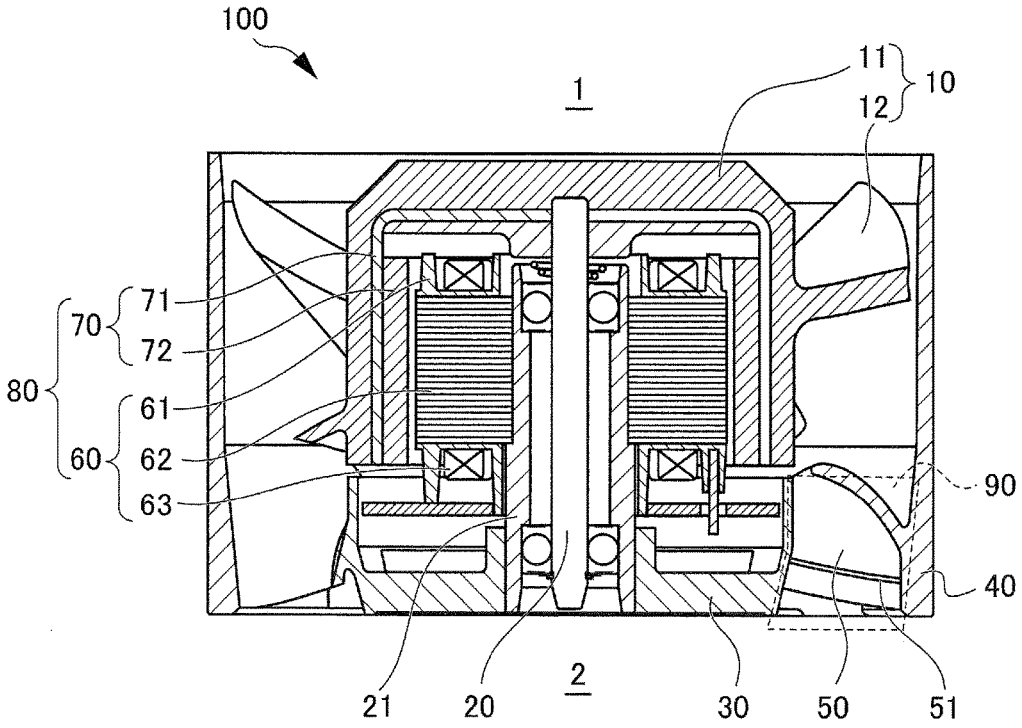
FIG. 1 is a longitudinal cross-sectional view illustrating an overall configuration of an axial flow fan of the present invention.

An overall structure of an axial flow fan 100 of the first embodiment of the present invention is described with reference to FIG. 1. FIG. 1 is a longitudinal cross-sectional view of the axial flow fan 100 of the present invention. As illustrated in FIG. 1, the axial flow fan 100 of the present invention comprises: an impeller 10 having a hub 11 and vanes 12 disposed at equal intervals on an outer peripheral portion of the hub 11; a rotor shaft 20 located at the center of the impeller 10 and fixed to the hub 11; a bearing housing 21 supporting the rotor shaft 20 rotatably, where a casing 40 surrounding the impeller 10 is connected to a base portion 30 by a stationary blade 50 while a bearing housing 21 is fixed to a base portion 30.

Meanwhile, in the first embodiment, by setting the bearing housing 21 to a mold and then supplying a resin into the mold, the base portion 30, the stationary blade 50 and the casing 40 are molded integrally. However, it is possible that only the base portion 30, the stationary blade 50 and the casing 40 are resin molded in advance, and then the bearing housing 21 is mounted to the center of the base portion 30.

Further, a stator 60 is configured by providing an insulator 61, a stator core 62 and a coil on the outer circumference of the bearing housing 21. On the other hand, a rotor 70 is configured by a rotor yoke 71 which is provided on the inside of the hub 11 of the impeller 10 integrally, and a rotor magnet 72 which is mounted on the inside of the rotor yoke 71. Meanwhile, in the above description, the rotor yoke 71 is integrally provided on the inside of the hub 11, but can be mounted on the inside of the hub 11.

Further, a motor portion 80 is configured by the stator 60 and the rotor 70, and the impeller 10 having a vane 12 is rotated by supplying current to a coil 63 from a power supply (not illustrated). By the rotation of the impeller 10, air is sucked from a suction opening side 1 in the side (top of FIG. 1) where the impeller 10 is disposed, and discharged to a blowout opening 2 in the side (bottom of FIG. 1) where the stationary blade 50 is disposed, through the inside of the casing 40.

(First Embodiment)

The axial flow fan 100 according to the first embodiment of the present invention is further described with reference to FIG. 1 to FIG. 5. As illustrated in FIG. 1, on the surface facing the blowout opening side 2 of the stationary blade 50, a guide portion 51 is formed over the casing 40 from the base portion 30. Specifically, the guide portion 51 is formed by forming an L-shaped groove on the surface of the stationary blade 50.

Figure 2:
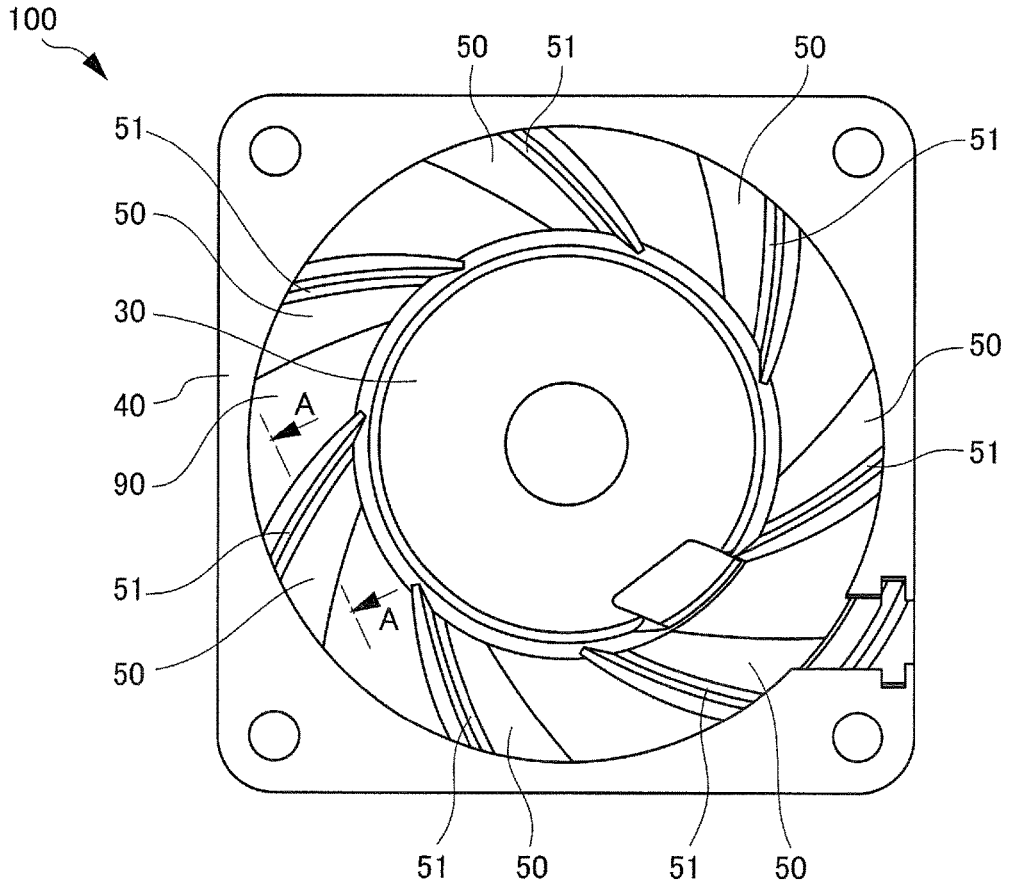
FIG. 2 is a view as viewed from the blowout opening side in FIG. 1.

FIG. 2 is a view as viewed from the blowout opening side 2 in FIG. 1 (but, only the base portion 30, the casing 40 and stationary blade 50 are illustrated, and the impeller 10 and the like are not illustrated). As illustrated in FIG. 2, the guide portion 51 is provided on each of the stationary blades 50. Then, as illustrated in FIG. 1, the stationary blade 50 is formed so as to connect the base portion 30 and the casing 40, in a flow path 90 which is formed by the base portion 30 and the casing 40. With regard to the flow path 90 portion, the outer shape of the base portion 30 is formed so as to incline to the center side toward the blowout opening side 2, while the inner shape of the casing 40 is also formed to incline to the center side toward the blowout opening side 2. Accordingly, the flow path 90 is formed such that the angle of the blowout opening faces the central axis side.

Then, when the air flow passes through the flow path 90, a component of the air flow which pivot in the circumferential direction is converted to a component of the central axis, by the stationary blade 50 in the flow path 90.

Figure 3A:
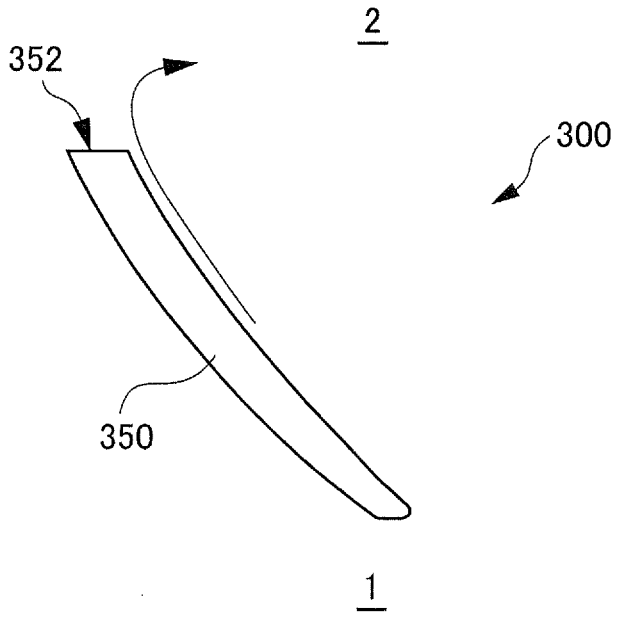
FIG. 3A is a cross-sectional view of a stationary blade provided with no groove.

FIG. 3 is a line A-A cross-sectional view of FIG. 2. It is illustrated such that the upper side of the figure is the blowout opening side 2 and the lower side of the figure is the suction opening side 1. That is, the figure is a cross-sectional view as viewed along the axial direction of the rotor shaft 20 (not illustrated) of the stationary blade 50. As illustrated in FIG. 3A, in the case of a general axial flow fan 300, a stationary blade 350 is designed to be curved gently toward the blowout opening side 2. Here, the air stream flowing along the surface near the surface of the stationary blade 350 is strongly influenced by the surface. Therefore, when the air flow flowing along the surface near the surface of the stationary blade 350 as indicated by arrows is leaving to the blowout opening side from an end portion 52 of the blowout opening side 2 of the stationary blade 350, warping of the stationary air flow coupled with the curved shape of the blade 350 is generated (hereinafter, the warping air flow is referred to as "warping component").

As indicated by the arrows, because the warping component is not the component directing toward the blowout opening side 2, the warping component becomes a factor that inhibits flow, for the air flow to flow toward the blowout opening side 2. Thus, the warping component acts as an air resistance to the air flow to flow toward the blowout opening side 2. Further, when there exists the air resistance to the air flow, load on the motor increases, and power consumption increases.

Figure 3B:
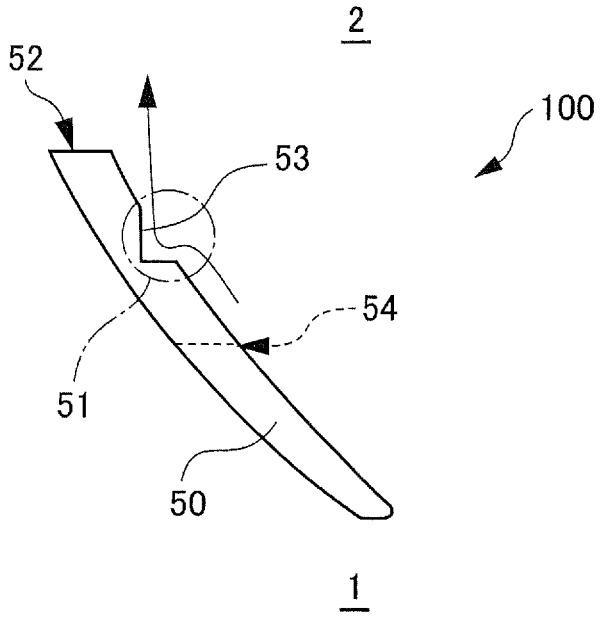
FIG. 3B is a cross-sectional view of a stationary blade having an L-shaped groove.

On the other hand, in the case of the stationary blade 50 of the axial flow fan 100 of the present invention illustrated in FIG. 3B, an L-shaped groove is provided as a guide portion 51, in front (suction opening side 1) of the end portion 52 of the blowout opening side 2 of the stationary blade 50. The L-shaped groove has longitudinal walls which are generally parallel to the rotor shaft 20 (not illustrated). The longitudinal wall is a guide surface 53 which guides the air flow flowing along the surface near the surface of the stationary blade 50 to the direction of the blowout opening side 2.

That is, as indicated by the arrows, the air flow which has flown along the surface near the surface of the stationary blade 50 flows along the guide surface 53, becomes an air flow toward the direction of the blowout opening side 2, and goes away from the surface of the stationary blade 50. As a result, the air flow flowing through the vicinity of the surface of the stationary blade 50 which reaches the end portion 52 of the blowout opening side 2 of the stationary blade 50 is reduced, generation of the warping component is suppressed, and the air resistance is also reduced as described above.

In addition, the air flow guided by the guide surface 53 becomes a flow that has been rectified so as to be directed to the blowout opening side 2 and so is discharged to the outside from the blowout opening efficiently. Thus, by providing the guide portion 51 (L-shaped groove) to a portion of the stationary blade 50, the air resistance to the air flow toward the blowout opening side 2 is reduced, and the air flow is discharged efficiently to the outside from the blowout opening. As a result, it is possible to reduce the load on the motor and to suppress the power consumption.

As illustrated in FIG. 3B, as viewed in a cross section along the central axis of the stationary blade 50, that is, in the direction along the axis of the rotor shaft 20 (not illustrated) of the stationary blade 50, the guide portion 51 is provided in the middle between the center position 54 of the stationary blade 50 and the end portion 52 of the blowout opening side 2.

On the other hand, if the position of the guide portion 51 is moved toward the suction opening side 1 (the lower side of FIG. 3B), that is, if the distance from the guide portion 51 to the end portion 52 is increased, the effect is reduced. It is considered that the air flow flowing along the surface near the surface of the stationary blade 50 is reduced once by the guide portion 51, but after that, by the time the air flow reaches the end portion 52, the air flow flowing near the surface of the stationary blade 50 gradually increases. Therefore, it is inferred that with increasing distance from the guide portion 51 to the end portion 52, the air flow flowing near the surface of the stationary blade 50 increases again, and with this, the warping component also increases.

On the contrary, if the position of the guide portion 51 is moved toward the end portion 52 of the blowout opening side 2, with moving of the position of the guide portion 51 toward the end portion 52 of the blowout opening side 2, the effect is also reduced. It is inferred that this has occurred because before the air flow leaves enough from the surface of the stationary blade 50 in a rectified state, the air flow to reach the end portion 52 of the blowout opening side 2 of the stationary blade 50 is increased, and the warping component is generated. Further, it is inferred that when the guide portion 51 comes very close to the end portion 52, the shape of the end portion 52 itself becomes changed and the air flow is disturbed in a more complicated way.

Thus, there exists an optimal position for the location where the guide portion 51 is provided. As illustrated in FIG. 3B, as the position, an approximately intermediate position between the center position 54 of the stationary blade 50 and the end portion 52 of the blowout opening side 2, in a direction along the axis of the rotor shaft 20 (not illustrated) of the stationary blade 50, is preferred.

Figure 4A:
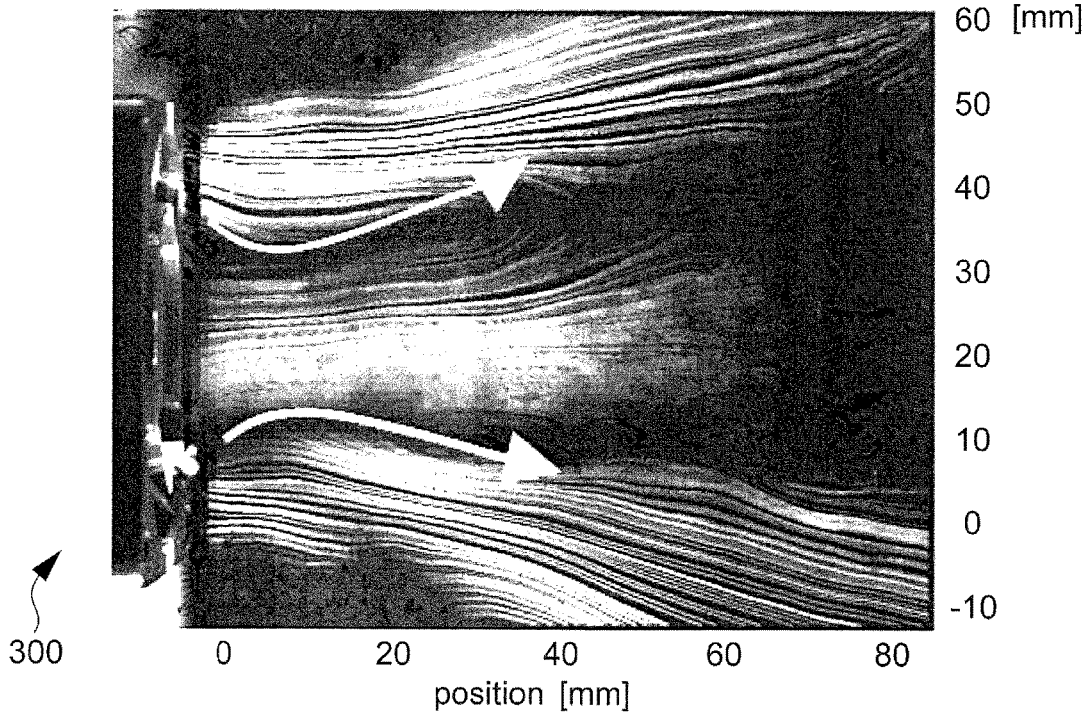
FIG. 4A is a diagram illustrating air flow blowing from the outlet in the case of the stationary blade of FIG. 3A.
Figure 4B:
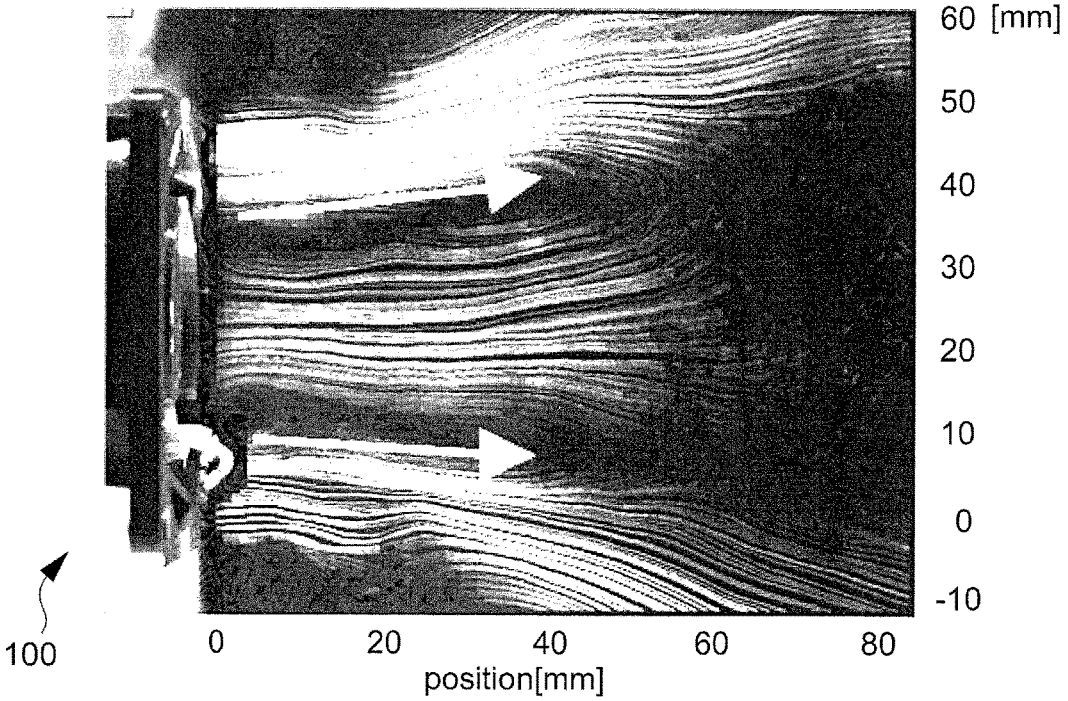
FIG. 4B is a diagram illustrating air flow blowing from the outlet in the case of the stationary blade of FIG. 3B.

FIG. 4A illustrates the state of the air flow which is blown out from the blowout opening of the general axial flow fan 300 using the stationary blade 350 illustrated in FIG. 3A. FIG. 4B illustrates the state of the air flow which is blown out from the blowout opening of the axial flow fan 100 of the present invention which is provided with the guide portion 51 formed of the L-shaped groove on a part of the stationary blade 50 illustrated in FIG. 3B.

As can be seen by comparing FIG. 4A and FIG. 4B, with regard to the air flow blown out from the blowout opening of FIG. 4A, the flow of the air flow which flows in the direction of the blowout opening is inhibited and disturbed by the influence of the warping component. As a result, the air flow does not jet in a linear mode, and a flow toward the center side is generated. In addition, by the influence exerted mutually between the air flows which have flown toward the center side, the flow diverges so as to spread.

On the other hand, in the case of the axial flow fan 100 of the present invention illustrated in FIG. 4B, with regard to the air flow which has blown out from the blowout opening, the warping component is reduced, and the rectified air flow which jets in a linear mode is generated, and so it is expected that the air resistance associated with the warping component also can be reduced.

On how the efficiency and the like change by the difference in the air flow, description shall be made with reference to FIG. 5. Note that the efficiency (%) described in the graph illustrated in FIG. 5, is the static pressure efficiency (=(static pressure×air flow quantity)/power consumption). Detailed description of the above equation of the static pressure efficiency is omitted because it is a commonly used evaluation equation. As a simple image, it is estimated by the equation what ratio of the energy is converted to the air flow, among the power consumption charged for rotating the impeller. Therefore, an axial flow fan with high static pressure efficiency means an excellent axial flow fan.

Figure 5A:
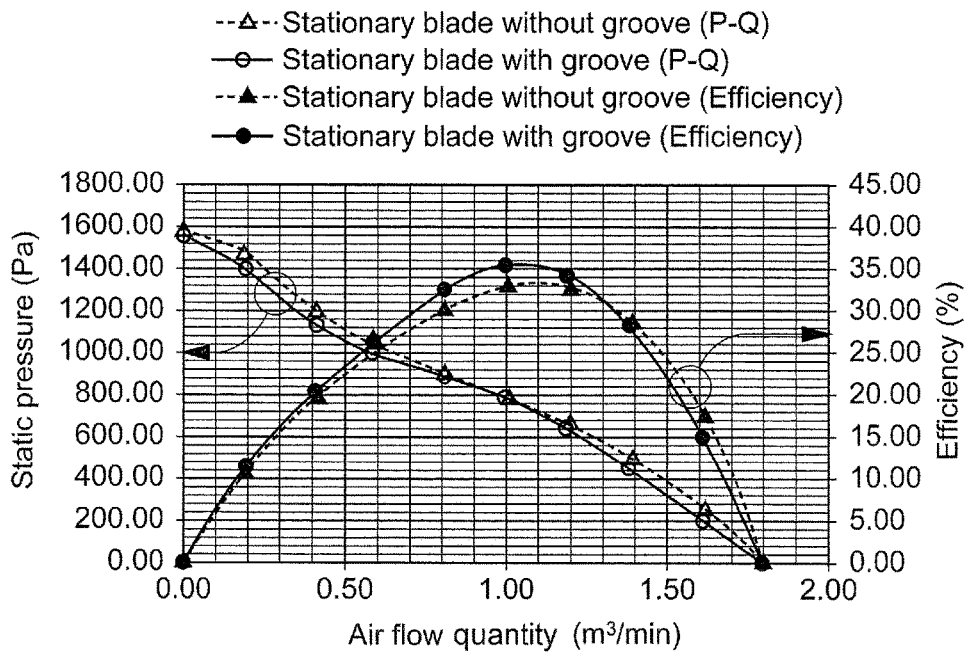
FIG. 5A is a graph illustrating static pressure-air flow quantity characteristics (P-Q), and static pressure efficiency (efficiency).

In the graph illustrated in FIG. 5A, static pressure (Pa) is taken on the left vertical axis, air flow quantity ($m^3$/min) is taken on the horizontal axis, and efficiency (static pressure efficiency) (%) is taken on the right vertical axis. In other words, the graph illustrated static pressure-air flow quantity characteristics (P-Q), and static pressure efficiency (efficiency). On the other hand, in the graph illustrated in FIG. 5B, efficiency is taken on the left vertical axis, air flow quantity ($m^3$/min) is taken on the horizontal axis, and power consumption (W) is taken on the right vertical axis. The data illustrated in the graphs are, the data of the general axial flow fan 300 with no groove on the stationary blade as illustrated in FIG. 3A, and the data of the axial flow fan 100 of the present invention which is different only in a point that a L-shaped groove is provided as the guide portion 51 thereon as illustrated in FIG. 3B.

Looking at the mid-range (in the vicinity of the air flow quantity of 1.00 $m^3$/min) which is a range used as the operating point of these axial flow fans, the static pressure-air flow quantity characteristics in the range shows little difference with or without the groove, as illustrated in FIG. 5A. However, as described above, with regard to the axial flow fan 100 of the present invention, because the air resistance to the air flow is suppressed, as illustrated in FIG. 5B, the power consumption required in the mid-range (in the vicinity of the air flow quantity of 1.00 $m^3$/min) is suppressed by about 2 to 3 W.

Figure 5B:
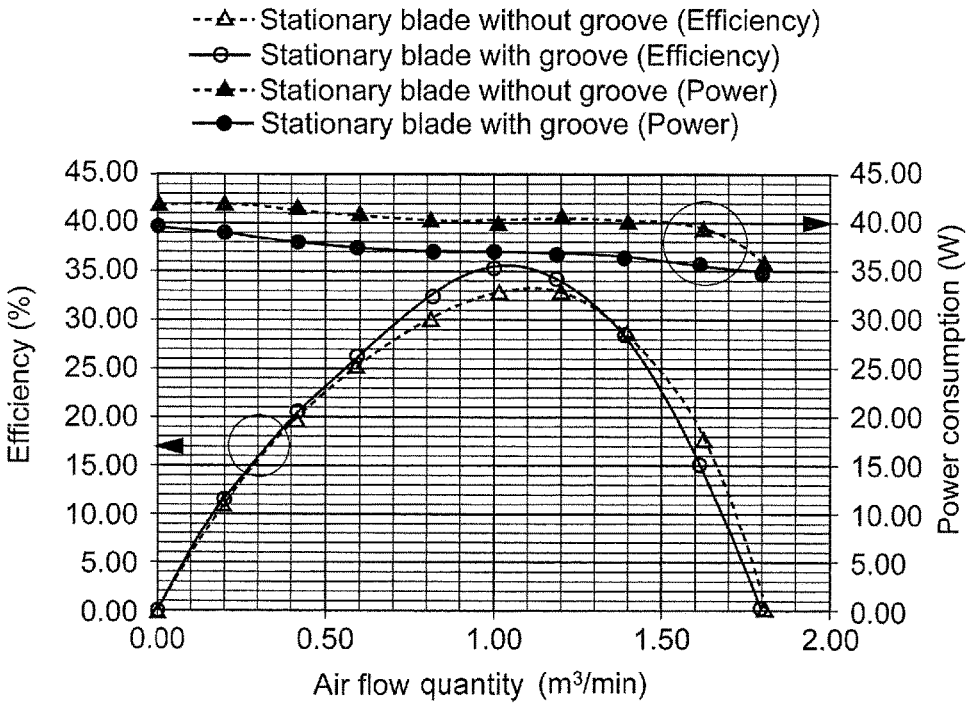
FIG. 5B is a graph illustrating power consumption, and static pressure efficiency (efficiency).

As a result, looking at the static pressure efficiency (efficiency) illustrated by FIG. 5A and FIG. 5B, due to the suppressing effect of the power consumption, in the air flow range of 0.4 to 1.4 $m^3$/min, the axial flow fan 100 of the present invention shows higher static pressure efficiency than the conventional the axial flow fan 300 which has no groove. In particular, in the air flow quantity region of 0.6 to 1.20 $m^3$/min (actual usage region), it can be clearly confirmed that the axial flow fan 100 of the present invention shows the higher static pressure efficiency.

As described above, the present invention, while following the structure of the conventional axial flow fan, improve the static pressure efficiency by providing the guide portion 51 on the surface of the stationary blade 50 which rectifies and guides the air flow flowing along the surface from the blowout opening to the outside. In addition, because the guide portion 51 has a very simple structure in which an L-shaped groove is provided on the surface of the stationary blade 50 facing the blowout opening side, the manufacturing cost does not increase and so increase in the product price can be suppressed.

(Second Embodiment)

Figure 6:
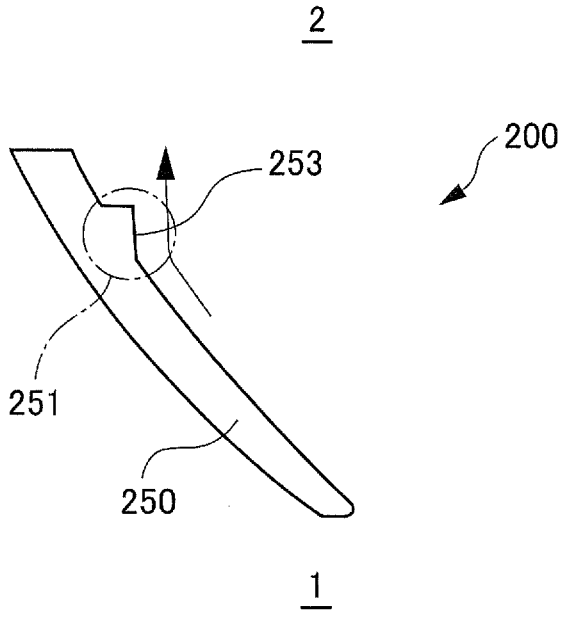
FIG. 6 is a cross-sectional view of a stationary blade provided with a projection of an inverse L-shape.

An axial flow fan 200 according to a second embodiment of the present invention shall be described with reference to FIG. 6. In the first embodiment, in order to configure the guide portion 51, the L-shaped groove having longitudinal walls substantially parallel to the rotor shaft 20 is provided on the surface of the stationary blade 50. On the other hand, as illustrated in FIG. 6, in the second embodiment, in order to configure the guide portion 251, an inverse L-shaped projection having longitudinal walls substantially parallel to the rotor shaft 20 (not illustrated) is provided on the surface of the stationary blade 250.

Even with such a configuration, the air flow flows along the guide surface 253, as indicated by the arrows in FIG. 6, the same state as described in detail with reference to FIG. 3B can be obtained, and so the static pressure efficiency can be increased. Further, the structure itself, like the L-shaped groove, has only an additional simple structure. Thus, the axial flow fan 200 of the second embodiment can also suppress the increase in the product price in the same way as in the first embodiment.

In the above description, while the present invention has been described with reference to the embodiments, the technical scope of the present invention is not limited to the scope described in the above embodiments. In the above embodiment, a case where a flow path 90 is formed so that the angle of the blowout opening faces the central axis side (see paragraph [0024] and FIG. 1).

However, for example, a flow path where the angle of the blowout opening is substantially parallel to the central axis, that is, a flow path of a straight shape along the axial direction is possible. Further, a flow path where the angle of the blowout opening faces outside (opposite direction to the central axis) is possible.

However, as described particularly in the above embodiment, the case of the flow path 90 where the angle of the blowout opening faces the central axis side showed that the effect of providing a guide surface was particularly large. Therefore, the configuration of the flow path 90 where the angle of the blowout opening faces the central axis side is preferable.

In the above embodiment, about the position where the guide portion 51 (251) is disposed and the state of the flow path 90, a preferred embodiment has been described particularly. However, the present invention is not limited to the specific embodiment. Without departing from the spirit of the present invention, various modifications and improvements can be added to the present invention, and it is apparent from the description of the appended claims that embodiments which are added with such modifications and improvements can be included in the technical scope of the present invention.

REFERENCE SIGNS LIST

1 . . . suction opening side, 2 . . . blowout opening side, 10 . . . impeller, 11 . . . hub, 12 . . . vane, 20 . . . rotor shaft, 21 . . . bearing housing, 30 . . . base portion, 40 casing, 50, 350 . . . stationary blade, 51, 251 . . . guide portion, 52 . . . end portion, 53, 253 . . . guide surface, 54 . . . center position, 60 . . . stator, 61 . . . insulator, 62 . . . stator core, 63 . . . coil, 70 . . . rotor, 71 . . . rotor yoke, 72 . . . rotor magnet, 80 . . . motor portion, 90 . . . flow path, 100, 200, 300 . . . axial flow fan

The invention claimed is:

1. An axial flow fan, comprising:
an impeller including a vane;
a rotor shaft;
a motor portion rotating the impeller around the rotor shaft as an axis;
a casing surrounding the impeller;
a base portion supporting the motor portion; and
a stationary blade located in a blowout opening of air flow, the stationary blade connecting the base portion and the casing, wherein
the stationary blade includes a first surface facing the blowout opening and a second surface facing a suction opening,
a surface of the base portion extends in a radial direction,
in a longitudinal direction of the rotor shaft, an entirety of the first surface is inclined to the surface of the base portion and is curved in a cross-sectional view of the stationary blade,
a groove opening toward the air flow is formed only in the first surface facing the blowout opening,
the groove is formed with two walls curvedly intersecting each other and is empty, and
the groove is a guide portion guiding the air flow flowing in a direction from the suction opening to the blowout opening.

2. The axial flow fan according to claim 1, wherein a cross-sectional shape of the groove is an L-shape.

3. The axial flow fan according to claim 1, wherein the rotor shaft is located at the center of the impeller.

4. The axial flow fan according to claim 1, wherein one of the two walls extends in a longitudinal direction of the rotor shaft.

5. An axial flow fan, comprising:
an impeller including a vane;
a rotor shaft;
a motor portion rotating the impeller around the rotor shaft as an axis;
a casing surrounding the impeller;
a base portion supporting the motor portion; and
a stationary blade located in a blowout opening of air flow, the stationary blade connecting the base portion and the casing, wherein
the stationary blade includes a first surface facing the blowout opening and a second surface facing a suction opening,
a surface of the base portion extends in a radial direction,
in a longitudinal direction of the rotor shaft, an entirety of the first surface is inclined to the surface of the base portion and is curved in a cross-sectional view of the stationary blade,
a groove opening toward the air flow is arranged in the first surface, the groove extending continuously from the base portion to the casing, the groove is formed with two walls curvedly intersecting each other and is empty, and
the groove is a guide portion guiding the air flow flowing in a direction from the suction opening to the blowout opening.

6. The axial flow fan according to claim 5, wherein a cross-sectional shape of the groove is an L-shape.

7. The axial flow fan according to claim 5, wherein the rotor shaft is located at the center of the impeller.

8. The axial flow fan according to claim 5, wherein one of the two walls extends in a longitudinal direction of the rotor shaft.

* * * * *